US005575040A

United States Patent [19]

Leifeld et al.

[11] Patent Number: 5,575,040

[45] Date of Patent: Nov. 19, 1996

[54] APPARATUS FOR CONTROLLING SLIVER DEPOSITION IN A COILER CAN

[75] Inventors: Ferdinand Leifeld, Kempen; Alexander Loos; Reinhard Hartung, both of Mönchengladbach, all of Germany

[73] Assignee: Trützschler GmbH & Co. KG, Mönchengladbach, Germany

[21] Appl. No.: 503,899

[22] Filed: Jul. 18, 1995

Related U.S. Application Data

[63] Continuation-in-part of Ser. No. 242,094, May 13, 1994, Pat. No. 5,446,946.

[30] Foreign Application Priority Data

May 14, 1993 [DE] Germany ..... 43 16 156.1
Mar. 9, 1994 [DE] Germany ..... 44 07 849.8

[51] Int. Cl.[6] ..... D04H 11/00; B65H 54/76; B65H 54/84

[52] U.S. Cl. ..... 19/159 A; 19/159 R; 242/363

[58] Field of Search ..... 19/159 A, 159 R; 242/361.3, 361.4, 361.5, 363; 307/179

[56] References Cited

U.S. PATENT DOCUMENTS 2,018,261 10/1935 Holdsworth .
3,088,690 5/1963 Haugwitz ..... 242/83
4,437,620 3/1984 Ozawa ..... 242/83
4,562,358 12/1985 Hosel ..... 307/179
5,237,726 8/1993 Gartenmann et al. ..... 19/159 R

FOREIGN PATENT DOCUMENTS 0344484 12/1989 European Pat. Off. .
493341 12/1991 European Pat. Off. .
1953988 2/1971 Germany .
3621794 1/1988 Germany .
426569 6/1967 Switzerland .
1270832 4/1972 United Kingdom .

*Primary Examiner*—John J. Calvert
*Attorney, Agent, or Firm*—Spencer & Frank

[57] ABSTRACT

A sliver coiler apparatus includes a machine frame; a stationary coiler plate supported in the machine frame; a coiler head rotatably supported in the coiler plate; a platform situated underneath the coiler plate; a coiler can positioned on the platform and having a vertically displaceable can bottom; and a control assembly for controlling a rate of downward movement of the can bottom. The control assembly includes an electronic control device; a mechanism for lowering the can bottom; and a pressure sensor responding to forces exerted by the sliver as the sliver filling operation proceeds. The drive of the lowering mechanism and the pressure sensor are connected to the electronic control device which controls the rate with which the mechanism moves the can bottom downwardly as a function of the signals generated by the pressure sensor.

11 Claims, 4 Drawing Sheets

APPARATUS FOR CONTROLLING SLIVER DEPOSITION IN A COILER CAN

CROSS REFERENCE TO RELATED APPLICATION

This application is a continuation-in-part of U.S. patent application Ser. No. 08/242,094 filed May 13, 1994, now U.S. Pat. No. 5,446,946 issued Sep. 5, 1995.

BACKGROUND OF THE INVENTION

This invention pertains to the field of fiber processing at the stage of spinning preparation and is particularly concerned with the handling of sliver outputted by a sliver-producing machine, such as a carding machine or a drawing frame.

Conventionally, the sliver exiting at the output end of the sliver-producing machine is deposited in a coiler can by a sliver coiler which is arranged at the output end of the sliver processing machine and which has a rotary coiler head supported in a stationary coiler plate. The upwardly open coiler can is situated underneath the coiler head which has an eccentrically arranged sliver outlet, so that upon rotation of the coiler head the sliver outlet orbits in a circular path, resulting in an annular (coiled) pattern of the sliver as it is deposited into the coiler can.

The diameter of the circular path travelled by the sliver outlet provided in the coiler head is less than the maximum horizontal linear dimension of the coiler can so that, to ensure sliver deposition in the entire cross-sectional area of the can, the can is moved underneath the coiler head while the latter rotates. The coiler can may be of circular cross section, in which the case the coiler can platform on which the coiler can stands is rotated about an axis which coincides with the longitudinal can axis. If the coiler can is of flat configuration, that is, it has an elongated rectangular horizontal cross-sectional outline, the platform is moved back and forth parallel to the length (longer side) of the flat coiler can.

Also conventionally, the coiler can is provided with a vertically displaceable bottom which is gradually lowered as the can is being filled with sliver. During such a process, the underface of the stationary head plate in which the rotary coiler head is supported is in contact with the momentarily uppermost sliver layer and thus a certain compression force is exerted to the deposited sliver material. As a simple, conventional solution, a coil spring is provided which urges the can bottom upwardly and which yields to the increasing weight of the sliver and thus the can bottom is automatically lowered as the filling process progresses.

It is a desideratum that the sliver fill be of homogenous consistency throughout the can height and that the sliver deposition proceed in a stable manner. One condition for achieving such a result is to ensure that the extent of compression of the sliver in the coiler can, that is, the pressure exerted on the sliver by the cooperation between the can bottom and the coiler plate remains constant regardless of the fill level, that is, regardless of the momentary height position of the can bottom. Such a uniform pressure cannot be satisfactorily ensured by a coil spring which urges the can bottom upwardly and which yields under the pressure of the sliver supported on the can bottom.

SUMMARY OF THE INVENTION

It is an object of the invention to provide an improved apparatus of the above-outlined type which has an electronic control for lowering the can bottom to ensure the maintenance of a uniform pressure on the sliver in the coiler can during the entire can-filling (sliver-depositing) process with simple means.

It is a further object of the invention to render the can bottom control independent of the weight of the sliver supported on the can bottom.

These objects and others to become apparent as the specification progresses, are accomplished by the invention, according to which, briefly stated, the sliver coiler apparatus includes a machine frame; a stationary coiler plate supported in the machine frame; a coiler head rotatably supported in the coiler plate; a platform situated underneath the coiler plate; a coiler can positioned on the platform and having a vertically displaceable can bottom; and a control assembly for controlling a rate of downward movement of the can bottom. The control assembly includes an electronic control device; a mechanism for lowering the can bottom; and a pressure sensor responding to forces exerted by the sliver as the sliver filling operation proceeds. The drive of the lowering mechanism and the pressure sensor are connected to the electronic control device which controls the rate with which the mechanism moves the can bottom downwardly as a function of the signals generated by the pressure sensor.

According to a preferred embodiment the pressure sensor is supported stationarily at the coiler plate for contacting the uppermost sliver layer in the coiler can. By virtue of positioning the pressure sensor above the sliver mass (at the coiler plate), the pressure sensor responds solely to the force exerted upwardly by the sliver mass compressed between the underface of the head plate and the can bottom. Thus, the pressure sensing is independent from the sliver weight in the coiler can.

According to another preferred embodiment, the pressure sensor travels with the can bottom and responds to the force exerted by the sliver on the can bottom.

It will be understood that the invention may be practiced with round (cylindrical) or flat coiler cans and with an arbitrarily selected type of can bottom lowering mechanism.

DESCRIPTION OF THE PREFERRED EMBODIMENTS

Figure 1:
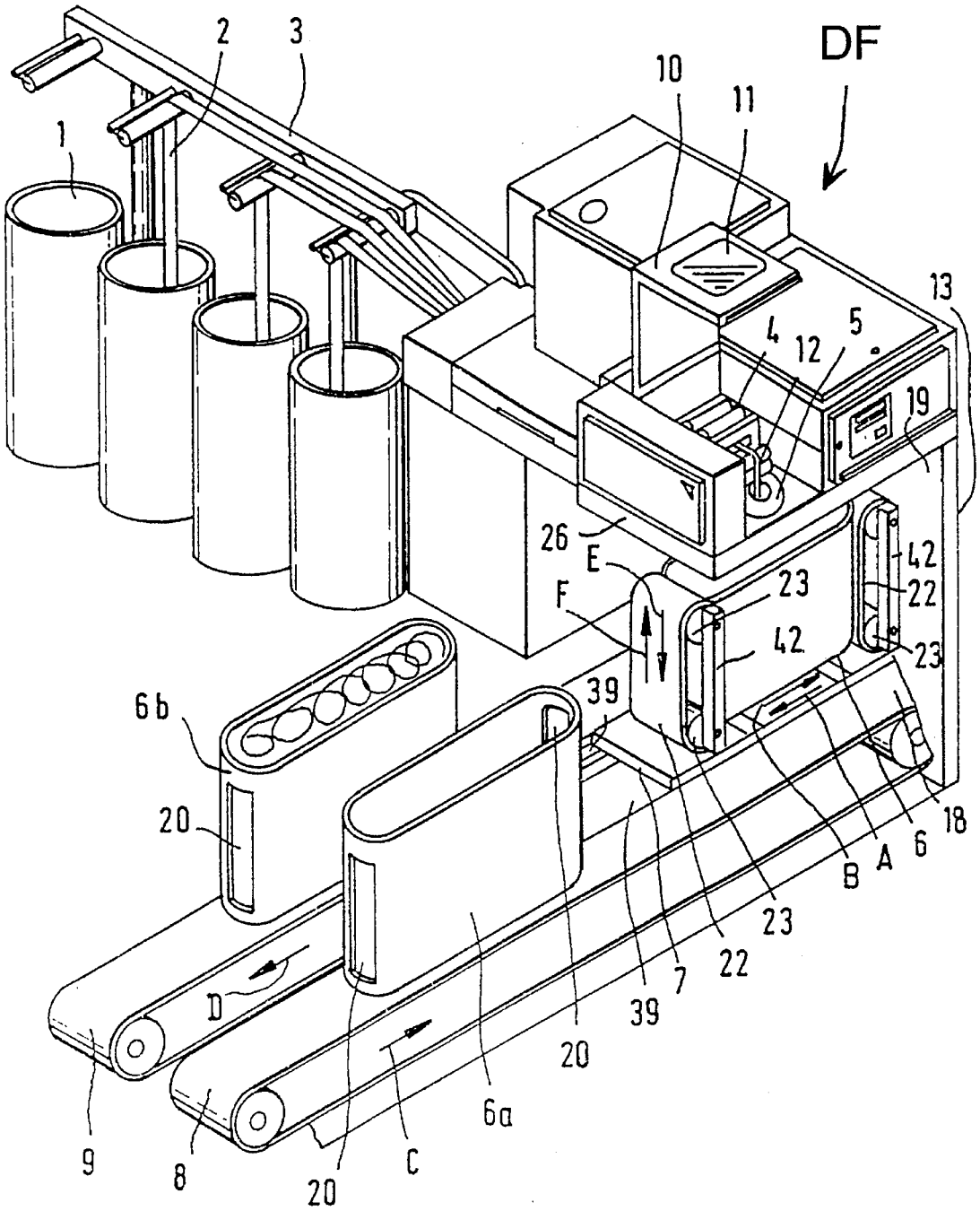
FIG. 1 is a schematic perspective view of a system including a drawing frame and a sliver coiler incorporating the invention.

Turning to FIG. 1, there are illustrated cylindrical coiler cans 1 situated underneath a sliver intake station 3 of a drawing frame DF. Slivers 2 from a plurality of cans 1 are simultaneously introduced into the drawing frame and guided through the drawing unit 4 which produces a sliver 12 introduced into the coiler head 5 of the sliver coiler and discharges the sliver 12 in a flat coiler can 6. The flat coiler can 6 stands on a sled 7 which is moved horizontally back and forth as indicated by the arrows A and B by means of a non-illustrated reciprocating device. The drawing unit 4 and the coiler head 5 are protected by a cover 10 which is provided with a window 11 to observe the drafting and sliver depositing operations. Adjacent a sliver charging station 19 immediately adjoining the sled 7 on either side thereof there are situated conveyor belts 8 and 9 for delivering empty cans 6*a* toward the charging station 19 in the direction of the arrow C and for transporting full cans 6*b* from the charging station 19 in the direction of the arrow D. The horizontal length dimension of the cans supported on the belts 8 and 9 is parallel to the conveying direction C, D. With the aid of, for example, a non-illustrated can exchanging device, a full can 6*b* may be pushed off the sled 7 onto the input end of the conveyor belt 9 and at the same time, an empty can 6*a* is pushed from the output end of the conveyor belt 8 onto the sled 7.

Figure 2:
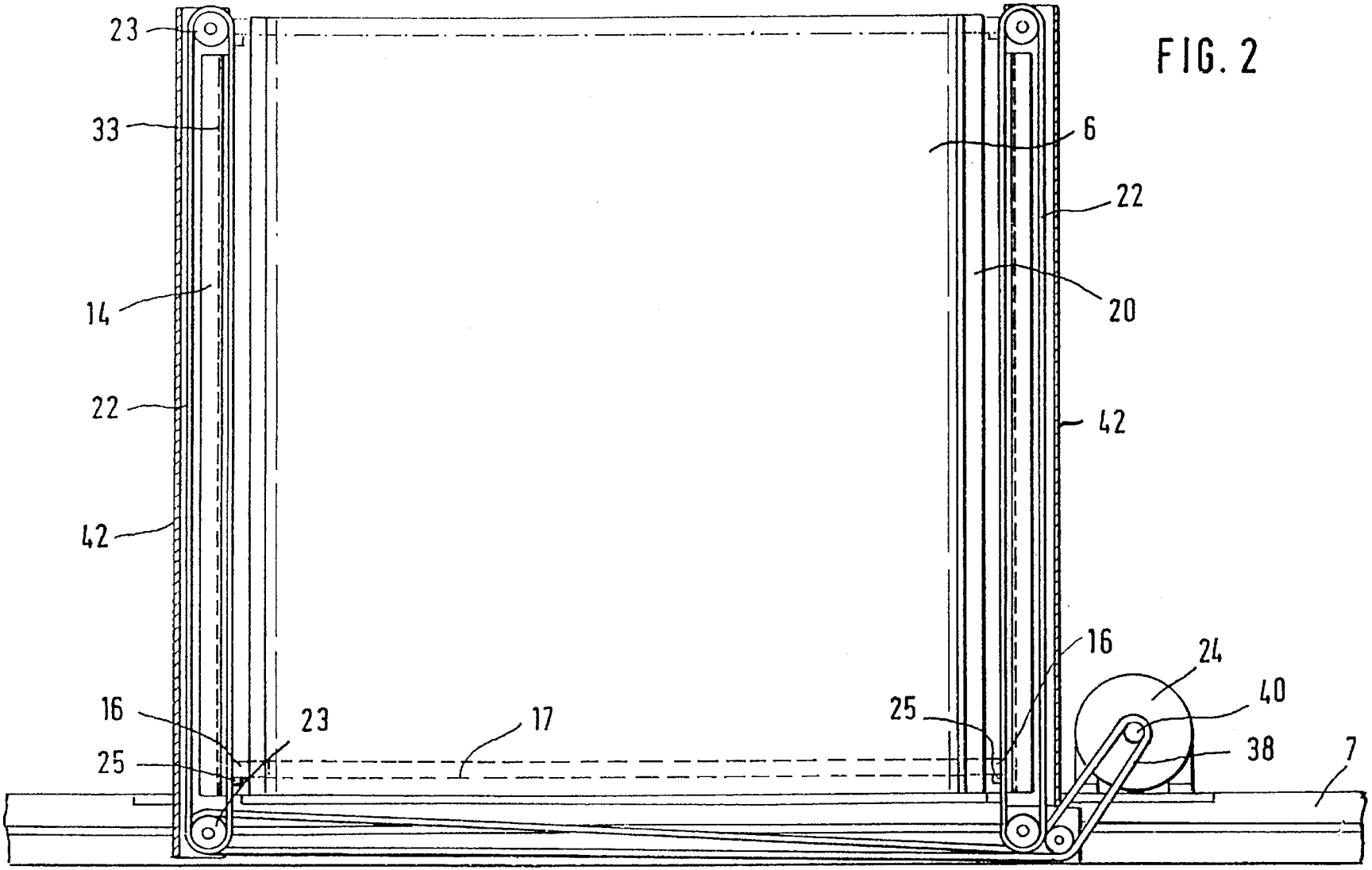
FIG. 2 is a side elevational view of an example of a can bottom-shifting device for use with the invention.

Also referring to FIG. 2, on the sled 7 a can bottom-shifting device 13 is mounted which includes a stand 42 supporting end sprockets 23 about which endless belts or chains 22 are trained. The can bottom 17 which is vertically displaceable relative to the can body 6 has, as a part thereof, engagement elements 16 which, on opposite small sides of the flat can 6, project therefrom through vertical slots 20 provided in the small sides. To the endless belts or chains 22 carrier elements 25 are affixed on which there are supported the engagement elements 16 of the can bottom 17. At least one of the end sprockets 23 is driven by a motor 24 with the intermediary of a belt pulley 40 and a drive belt 38. The motor 24 is of the reversible type and may run with variable rpm's in either direction. The carrier elements 25 and the engagement elements 16, upon arrival of an empty can 6*a* on the sled 7, assume a vertically superposed relationship, so that an upward displacement of the carrier elements 25 will cause an upward shift of the engagement elements 16 and thus the can bottom 17.

Figure 3:
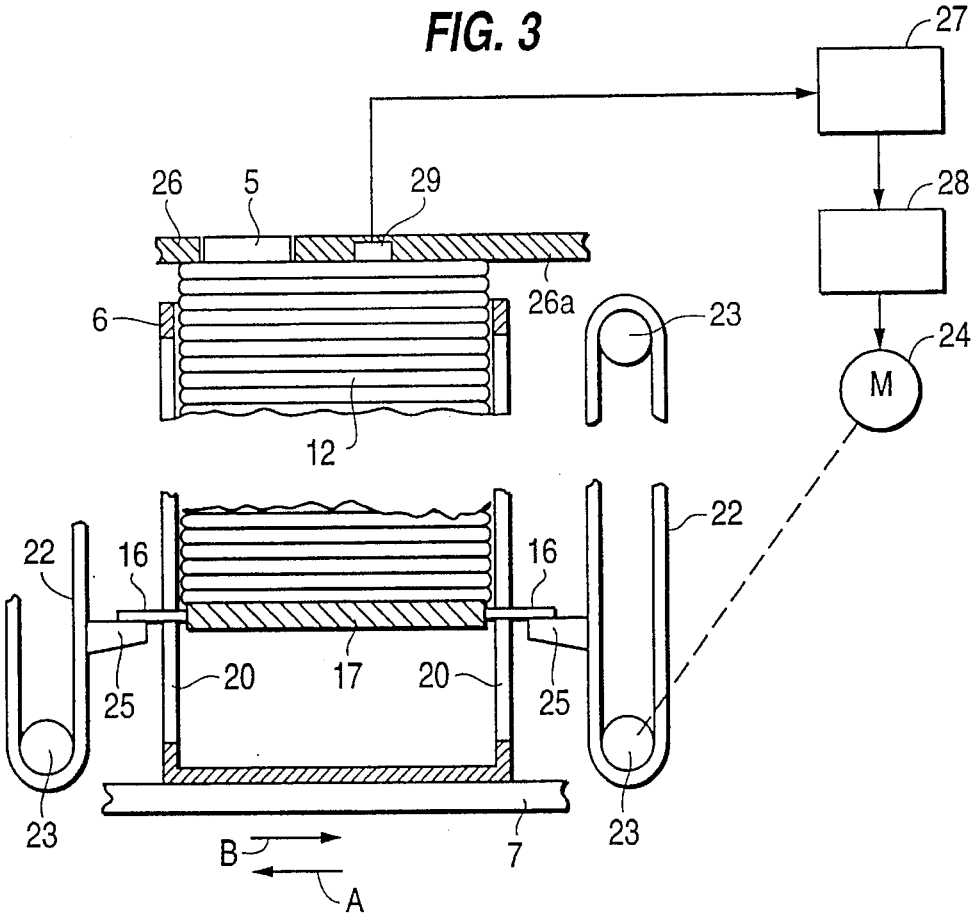
FIG. 3 is a schematic side elevational view of an apparatus according to the invention including a preferred embodiment and a block diagram illustrating principles of control.

Turning to FIG. 3, the coiler head 5 of the schematically illustrated sliver coiling apparatus is in the process of charging with sliver 12 the flat coiler can 6 which stands on the sled 7 and is reciprocated in the direction of the arrows A and B. The coiler head 5 is supported in a stationary coiler plate 26 held in the machine frame. As sliver deposition is in progress, the upper coils project beyond the upper rim of the coiler can 6 and the top layer (top coil) of the sliver 12 is in engagement with underface 26*a* of the coiler plate 26. It is noted that the distance between the upper can rim and the underface 26*a* of the coiler plate is not drawn to scale in the schematic illustration.

An electronic control and regulating device 27 is connected to the motor 24 by a motor regulator 28.

A pressure sensor 29 is installed in the coiler plate 26 such that its pressure sensing face is substantially coplanar with the underface 26*a* of the coiler plate 26, so that the pressure sensor 29 generates signals representing the force against which the sliver 12 is pressed against the underface 26*a* and the signals are applied by the pressure sensor 29 to the control and regulating device 27. To ensure that a predetermined constant compressing force is exerted vertically to the sliver 12 in the coiler can 6, the control and regulating device 27 regulates the rpm of the motor 24 such that the force exerted by the top layer of the sliver 12 on the pressure sensor 29 remains constant. Stated differently, the rpm of the motor 24 will be such that the rate of downward motion of the carrier elements 25 mounted on the endless belts 22 in conjunction with the depositing rate of the coiler head 5 will ensure a uniform vertical compression of the sliver in any height position of the descending can bottom 17 supported on the carrier elements 25 by means of the engagement elements 16 attached to the can bottom 17 and projecting outwardly through the can slots 20. Thus, if, for example, the control and regulating device 27 detects a weakening of the signal emitted by the pressure sensor 29 because of a drop in the upwardly exerted force of the sliver 12 caused, for example, by a decrease in the depositing rate of the coiler head 5 or by a decreasing density of the momentarily deposited sliver, a control output signal of the device 27 will cause the motor 24 to decrease its rpm, causing a slowdown of the rate of the downward movement of the can bottom 17, thus increasing the upwardly directed force exerted by the sliver 12 on the underface 26*a* of the coiler plate 26 and thus on the pressure sensor 29, reestablishing, by regulation, the preset, desired pressure. Such an increase in force is representative of the increase of pressure on the sliver by the cooperation between the coiler plate 26 and the can bottom 17. The pressure sensor 29 may be, for example, a conventional piezoelectric or strain gauge sensor. Its surface exposed to contact with the sliver 12 may be situated within the outline of the underface 26*a* of the head plate 26, as shown in FIG. 3.

It is to be understood that different types of sensors may be arranged at the coiler plate to practice the invention. Thus, the embodiments shown in FIGS. 4, 5 and 6 illustrate pressure sensors whose pressure responsive surface is externally of the outline of the head plate 26 and the associated detector detects the extent of displacement of the sensor member carrying the pressure responsive surface.

Figure 4:
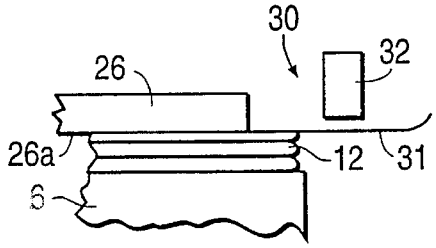
FIGS. 4, 5, 6 and 7 are schematic side elevational views of three further preferred embodiments of the invention.

Thus, the pressure sensor generally designated at 30 in FIG. 4 includes a leaf spring 31 which, at one end, may be attached on or in the immediate vicinity of the head plate 26 and which cooperates with a proximity switch arrangement generally designated at 32, such as an inductive proximity switch. In such a case, the leaf spring 31 has a metal part whose distance is sensed by the proximity switch 32.

Figure 5:
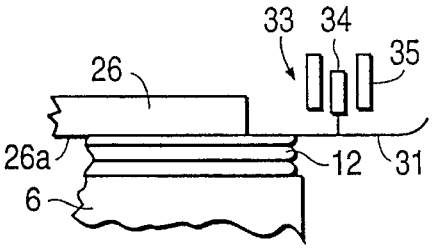

In the embodiment illustrated in FIG. 5, the leaf spring 31 is associated with a solenoid-type signal generator generally designated at 33. The sensor includes a plunger armature 34 mounted on the leaf spring 31 and a solenoid 35 which generates a signal representing the extent of penetration of the armature 34 into the solenoid 35.

Figure 6:
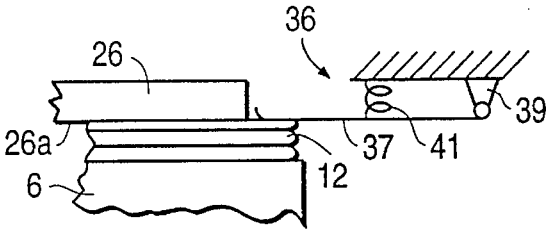

In the embodiment shown in FIG. 6, the pressure responsive arrangement generally designated at 36 includes a movable arm 37 (which, by itself, may be generally non-resilient) held at one end by a pivot 39 mounted on the machine frame. The arm 37 extends from the pivot 39 towards the head plate 26 to be engaged from below by the upper layer of the sliver 12 as shown. The arm 37 is urged downwardly, that is, into contact with the sliver 12 by a compression spring 41 supported on the machine frame. The movable arm 37 may be associated with a signal generating device 32 (FIG. 4) or 34, 35 (FIG. 5).

Figure 7:
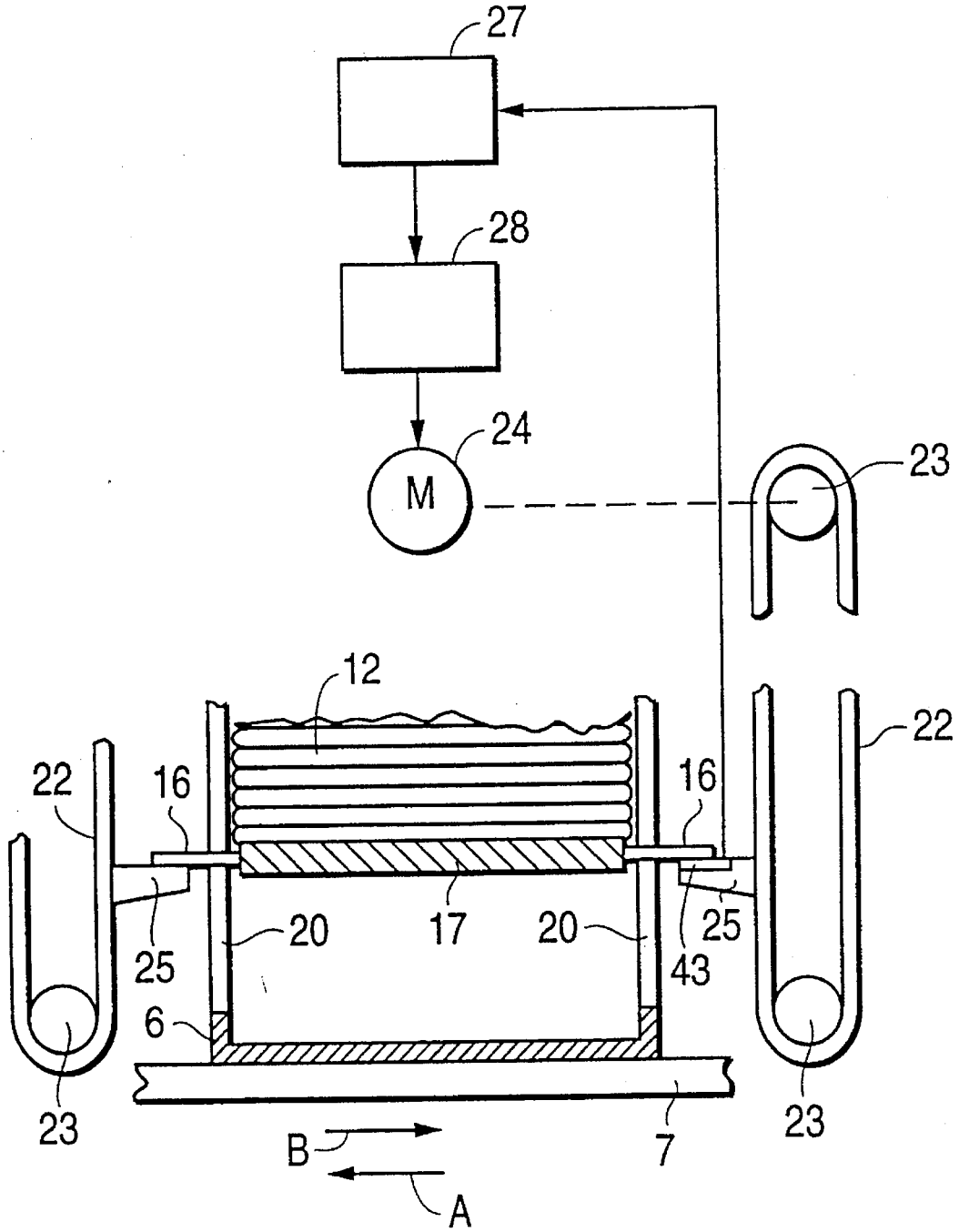

FIG. 7 illustrates an embodiment which, in contrast to the embodiments shown in FIGS. 3–6, is provided with a pressure sensor 43 that travels together with the can bottom 17. The pressure sensor 43 is installed in the carrier element 25 attached to the endless belt 22 and contacts the underface of the engagement element 16 which is supported on the carrier element 25 and which forms part of the can bottom 17. Thus, the sensor 43 responds to the downward force exerted thereon by the engagement element 16. Such a force is essentially composed of the compression force exerted vertically on the sliver 12 supported on the can bottom 17 as well as the sliver weight which increases as the bottom 17 descends during the sliver filling operation. The signals generated by the pressure sensor 43 are applied to the control and regulating device 27. The pressure sensor 43 may be of the type as described for the pressure sensor 29 forming part of the FIG. 3 embodiment.

While in the sensor arrangements illustrated in FIGS. 3–6, the weight of the sliver has no effect on the sensor signals, this is not the case in the FIG. 7 embodiment where, as noted above, the forces to which the sensor 43 responds includes the sliver weight. If it is desired to eliminate the effect of the weight on the rpm control of the motor 24, the control and regulating device 27 has to modify the processed signals by deducting the momentary sliver weight. A signal representing such momentary weight may be generated, for example, by a path sensor whose signals represent the height level of the can bottom 17 and thus the momentary fiber quantities situated in the coiler can 6. Such a path sensor may be based, for example, on a rotary angle indicator which emits signals that represent the angle of rotation of the shaft of the motor 24. From such data then the displacement of the belt 22 and the carrier element 26 may be calculated, yielding the height position of the can bottom 17.

It will be understood that the above description of the present invention is susceptible to various modifications, changes and adaptations, and the same are intended to be comprehended within the meaning and range of equivalents of the appended claims.

What is claimed is:

1. A sliver coiler apparatus for depositing sliver, comprising (a) a machine frame;

(b) a stationary coiler plate supported in said machine frame; said coiler plate having a peripheral outline and an underface;

(c) a coiler head rotatably supported in said coiler plate;

(d) a platform situated underneath said coiler plate;

(e) an upwardly open coiler can supported in an upright position on said platform for receiving sliver from said coiler head in an annular pattern such that a momentarily uppermost sliver layer is in contact with said underface of said coiler plate; said coiler can having a vertically-displaceable can bottom for supporting sliver deposited by said coiler head into said coiler can; and (f) control means for controlling a rate of downward movement of said can bottom during deposition of sliver into said coiler can by said coiler head; said control means including (1) an electronic control device;

(2) means for lowering said can bottom, including (i) a vertically-movable support member engaging said can bottom for movement with said can bottom;

(ii) a drive connected to said support member for lowering said support member; said drive being connected to said electronic control device; and (3) a pressure sensor responsive to forces exerted by the sliver; said pressure sensor being connected to said electronic control device for controlling the rate of downward movement of said can bottom as a function of said signals; and (4) support means for positioning said pressure sensor for exposure to the forces exerted by the sliver.

2. The sliver coiler apparatus as defined in claim 1, wherein said pressure sensor is supported at said coiler plate at a height level of said underface for exposure to contact by an upper sliver layer in said coiler can during sliver deposition for generating signals representing forces exerted thereon upwardly by the sliver in the coiler can.

3. The sliver coiler apparatus as defined in claim 2, wherein said pressure sensor has a member mounted in said cooler plate; said member including a pressure-sensing surface situated within said peripheral outline for exposure to contact by an upper sliver layer in the coiler can.

4. The sliver coiler apparatus as defined in claim 2, wherein said pressure sensor has a member including a portion forming a pressure-sensing surface situated externally of said peripheral outline; said pressure-sensing surface being arranged for exposure to contact by an upper sliver layer in the coiler can.

5. The sliver coiler apparatus as defined in claim 4, wherein said member of said pressure sensor comprises a leaf spring having an area constituting said pressure-sensing surface.

6. The sliver coiler apparatus as defined in claim 5, wherein said leaf spring has a portion adjacent said pressure-sensing surface; said portion being affixed to said coiler plate.

7. The sliver coiler apparatus as defined in claim 4, wherein said pressure sensor includes signal-generating means for generating said signals in response to a position of said member at a predetermined distance from said signal-generating means.

8. The sliver coiler apparatus as defined in claim 4, wherein said signal-generating means comprises a solenoid and an armature affixed to said member and cooperating with said solenoid for generating a signal as a function of a displacement of said armature relative to said solenoid.

9. The sliver coiler apparatus as defined in claim 4, wherein said pressure sensor includes a support pivotally holding said member and a spring resiliently urging said portion of said member in a direction of said can bottom.

10. The sliver coiler apparatus as defined in claim 1, wherein said support means includes means for causing said pressure sensor to co-travel with said can bottom and for positioning said pressure sensor for exposure to the forces exerted by the can bottom.

11. The sliver coiler apparatus as defined in claim 10, wherein said pressure sensor is mounted on said vertically-movable support member.

* * * * *